US006021702A

United States Patent [19]

Rexroad

[11] Patent Number: 6,021,702

[45] Date of Patent: Feb. 8, 2000

[54] AESTHETIC BARRIER/DEBRIS SYSTEM AND MATERIAL

[76] Inventor: John Rexroad, 12 Jackson Rd., Killingworth, Conn. 06419

[21] Appl. No.: 09/020,830

[22] Filed: Feb. 9, 1998

[51] Int. Cl.[7] ..... A63B 61/04

[52] U.S. Cl. ..... 87/12; 87/13; 256/37; 473/493

[58] Field of Search ..... 87/12, 13; 473/493, 473/491, 494, 490; 256/37, 40, 44, 45, 32; 182/129

[56] References Cited

U.S. PATENT DOCUMENTS

| | | | |
|---|---|---|---|
| 1,635,416 | 7/1927 | Howard | 273/29 BE |
| 1,700,192 | 1/1929 | Appleyard . | |
| 1,959,574 | 5/1934 | Dunscombe . | |
| 2,094,919 | 10/1937 | Hughes . | |
| 2,129,569 | 9/1938 | Lay | 254/83 |
| 2,194,865 | 3/1940 | Mizugoshi . | |
| 2,407,031 | 9/1946 | Morcaldi D' . | |
| 2,470,318 | 5/1949 | Nadelson | 273/30 |
| 2,600,395 | 6/1952 | Domoj et al. . | |
| 2,659,956 | 11/1953 | Lilienfeld . | |
| 2,792,617 | 5/1957 | Haller . | |
| 2,817,263 | 12/1957 | Pedley et al. . | |
| 2,823,576 | 2/1958 | Needham et al. . | |
| 2,910,096 | 10/1959 | Frey . | |
| 2,925,141 | 2/1960 | Frieder et al. . | |
| 3,008,711 | 11/1961 | Dillon . | |
| 3,039,348 | 6/1962 | Grabowsky et al. . | |
| 3,047,860 | 7/1962 | Swallow et al. . | |
| 3,118,294 | 1/1964 | Van Laethem . | |
| 3,170,611 | 2/1965 | Gullen . | |
| 3,435,487 | 4/1969 | Mazzei et al. | 24/73 |
| 3,961,789 | 6/1976 | Tabacheck | 273/29 BE |
| 4,000,344 | 12/1976 | Dilbey . | |
| 4,068,846 | 1/1978 | Forrest . | |
| 4,078,795 | 3/1978 | Porter | 273/3 |
| 4,158,985 | 6/1979 | Looker et al. . | |
| 4,257,309 | 3/1981 | Dunahoo . | |
| 4,619,108 | 10/1986 | Hotta . | |
| 4,651,620 | 3/1987 | Lyons . | |
| 4,844,455 | 7/1989 | Funkhouser | 273/29 BF |
| 4,892,210 | 1/1990 | Kupersmit . | |
| 4,895,366 | 1/1990 | Bartasius . | |
| 4,948,129 | 8/1990 | Bartasius . | |
| 4,986,389 | 1/1991 | Halligan, Sr. et al. . | |
| 5,011,710 | 4/1991 | Harrison . | |
| 5,052,686 | 10/1991 | Pryor . | |
| 5,078,365 | 1/1992 | Fultz | 256/1 |
| 5,134,030 | 7/1992 | Ueda et al. . | |
| 5,225,262 | 7/1993 | Leduc . | |
| 5,240,769 | 8/1993 | Ueda et al. . | |
| 5,299,655 | 4/1994 | Margaritis . | |
| 5,328,310 | 7/1994 | Lockney . | |
| 5,344,157 | 9/1994 | McCord . | |
| 5,393,051 | 2/1995 | Merino et al. | 273/29 B |
| 5,402,988 | 4/1995 | Eisele | 256/45 |
| 5,408,770 | 4/1995 | Suzuki . | |
| 5,433,852 | 7/1995 | Tseng et al. . | |
| 5,582,266 | 12/1996 | Rexroad et al. . | |
| 5,622,094 | 4/1997 | Rexroad . | |
| 5,752,550 | 5/1998 | Scari' et al. . | |
| 5,758,868 | 6/1998 | Shea . | |
| 5,789,025 | 8/1998 | St. Clair . | |

FOREIGN PATENT DOCUMENTS

| | | | |
|---|---|---|---|
| 879729 | 3/1943 | France . | |
| 20725 | 8/1913 | United Kingdom | 473/119 |
| 203228 | 9/1923 | United Kingdom . | |
| 347029 | 4/1931 | United Kingdom . | |

OTHER PUBLICATIONS

Navy Drawing May 14, 1987 (1 page).
Pucuda Fun Catalog (11 pages).
Fine Home Building, Jan. 1996 No. 99 (pp. 90–93).

*Primary Examiner*—John J. Calvert
*Assistant Examiner*—Tejash Patel
*Attorney, Agent, or Firm*—Perman & Green, LLP

[57] ABSTRACT

A system for connecting a panel to a support comprises a mesh panel defined by at least one length portion and has a border connected to the length portion of the mesh panel. The border and has a first end capable of being connected to a support and a second end adjustably connectable to an opposite support. A tensioning means is associated with the border second end for pulling the border in tension between the supports. The second end of the web is connectable to the tensioning means for tensioning the mesh panel material.

15 Claims, 8 Drawing Sheets

52

52

AESTHETIC BARRIER/DEBRIS SYSTEM AND MATERIAL

CROSS REFERENCE TO RELATED APPLICATIONS

The present invention relates to copending U.S. patent application Ser. No. 08/789,416 filed Jan. 29, 1997 and entitled, Flat Braid With Web Core, and also relates to copending U.S. application Ser. No. 08/414,185 entitled Hollow Braid Net and Method of Making, filed Mar. 31, 1995 and further relates to copending U.S. application Ser. No. 08/557,851, entitled Net With Flattened Surface Members Connected At Sewn Intersections, and to copending U.S. application Ser. No. 09/012,472, entitled Method of Using Barrier Material and System, filed Jan. 22, 1998 under EXPRESS MAIL No. EM174706093US, which applications being commonly owned and being hereby incorporated by reference herein.

BACKGROUND OF THE INVENTION

The present invention relates to a barrier which is usable as a decorative finish in a construction project, such as will be conducted on the Washington Monument in Wash. D.C., wherein mesh panels are connected to scaffolding or other structure in a manner which presents the mesh outwardly to a viewer in a flat sheet form.

When a scaffolding is erected around a structure, such as around the Washington Monument, and work operations conducted on it, it is often necessary to enshroud the work environment so as to make the exterior appearance of the structure aesthetically pleasing to the viewers, especially in a landscape where an object stands out relative to the remainder of the environment. Prior art systems all include a secondary member, such as a cable, which needed to be used suspended between two vertical members so that tarpons could hang from the cable. Such a system does not provide a mesh which can be made taut and given a flat face appearance, which is part of a desired architectural effect.

Accordingly, it is an object of the invention to provide a decorative and/or debris inhibiting mesh panel which can be readily fastened to existing scaffolding erected around a structure so as to provide a more aesthetically pleasing view of the structure during construction and renovation, and provide ease of installation, maintenance and removal.

It is yet a further object of the invention to provide a mesh panel system whereby each panel is capable of being separately adjusted relative to the support to which it is attached such that a self-supporting system can be effected.

Still a further object of the invention is to provide a system of the aforementioned type which uses a hollow border member in which a slidable web or support member is housed in order to reduce secondary support systems which otherwise would be necessary in the installation of a mesh panel system.

Still a further object of the invention is to provide a system of the aforementioned type which uses a border member on which a plurality of loops are sewn in order to secure discrete sections of the mesh to vertically extending members.

Yet a further object of the invention is to provide a material of the aforementioned type which is capable of having a given color which is coordinated with the color scheme of a given environment.

Further objects and advantages of the present invention will become apparent from the following disclosure and appended claims.

BRIEF DESCRIPTION OF THE DRAWINGS

FIG. 9 illustrates in side elevation view the ratchet of

FIG. 8 usable with the mesh of the types illustrated in FIGS. 4 and 5.

SUMMARY OF THE INVENTION

The invention resides in a system for connecting a panel to a support and comprises a mesh panel defined by at least one length portion and has a border connected to the length portion of the mesh panel. The border and has a first end capable of being connected to a support and a second end adjustably connectable to an opposite support. A tensioning means is associated with the border second end for pulling the border in tension between the supports. The second end of the web is connectable to the tensioning means for tensioning the mesh panel material.

DETAILED DESCRIPTION OF THE PREFERRED EMBODIMENTS

Figure 1:
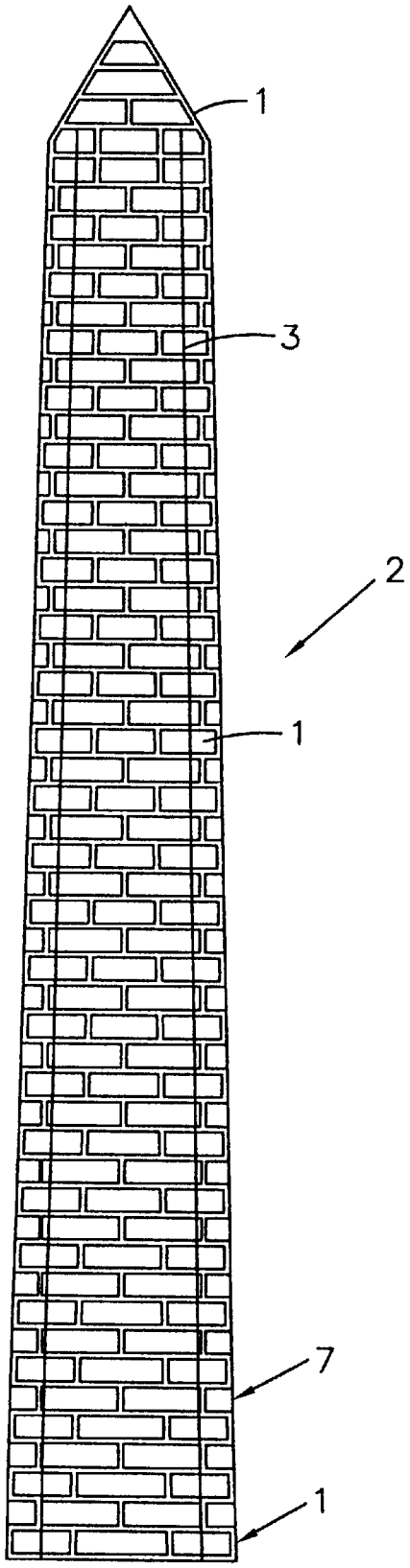
FIG. 1 is an elevation view of a structure which is enshrouded by scaffolding and covered by the panels of the present invention to create a desired appearance, and debris protection.

Referring now to FIG. 1 therein shown is a system 2 for mounting a mesh 1 onto a scaffolding system 7 which is erected around a structure 3, or to other structures, such as concrete columns in a construction project.

Figure 2:
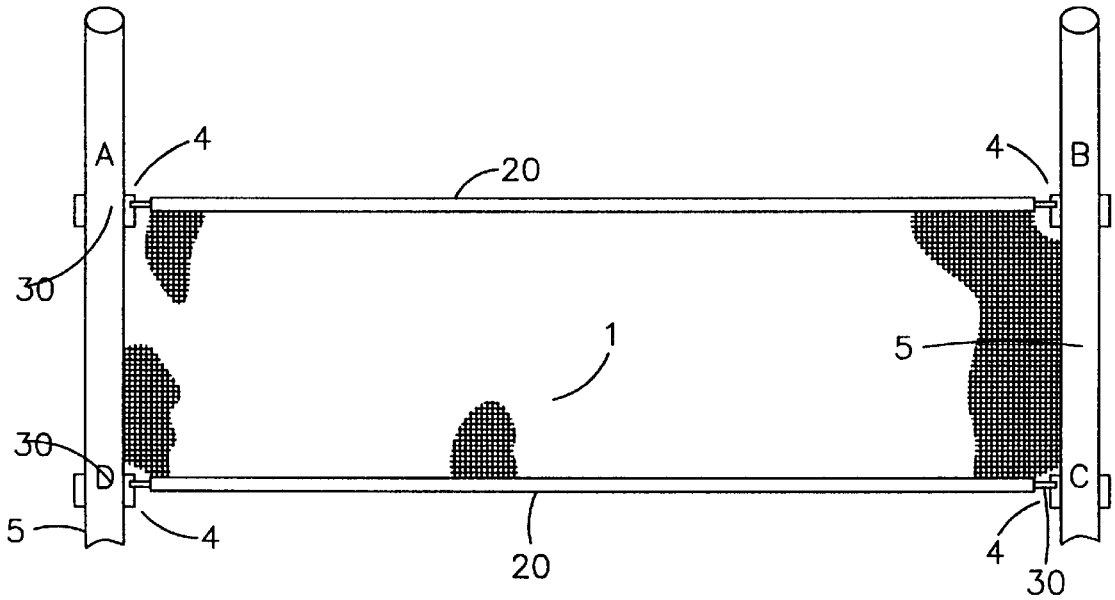
FIG. 2 is a partially fragmentary elevation view of a panel mounted in place on a scaffolding system.

As seen in FIG. 2, the mesh 1 is adapted to be secured between two upstanding support members 5,5 of the scaffolding system. Each mesh panel 1 connects to the upstanding support members 5,5 and four given points a,b,c,d which gives the panels a highly stable and flat face appearance effect.

The system illustrated generally as 2 is disclosed for use in a new and unobvious application for a decorative debris barrier material on a scaffolding system. Each mesh panel is highly simplified having the mesh material 1,1, at least two ratchets, 36 or 60, and a border 20,20' which is connected to the mesh panel in a manner as will be discussed herein.

Figure 3:
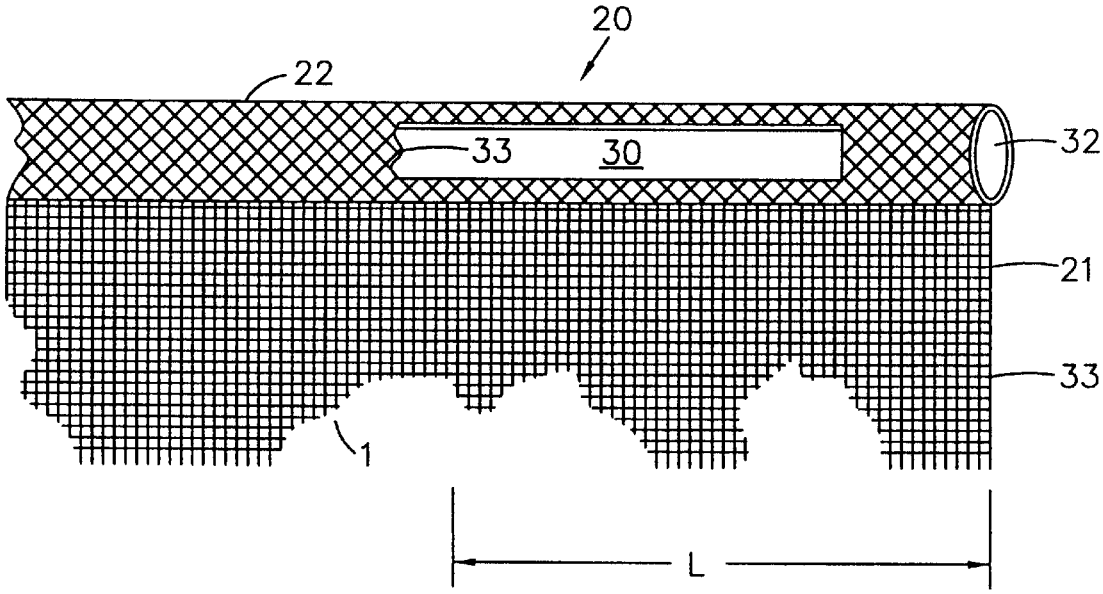
FIG. 3 illustrates a partially fragmentary elevational view of a first embodiment of a panel of the present invention showing the free end corner which is adapted to be received within a ratchet device.
Figure 4:
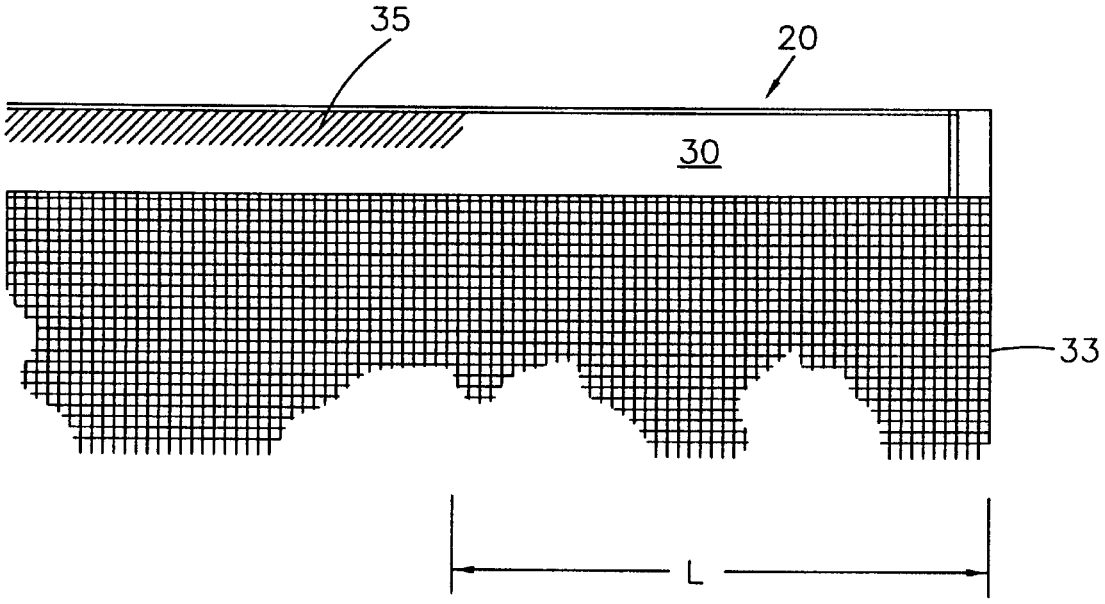
FIG. 4 illustrates a partially fragmentary elevational view of a second embodiment of a panel of the present invention showing the free end corner which is adapted to be received within a ratchet device.

Referring now to FIGS. 3 and 4, and to the methods by which the webbing is attached to the panel, it should be seen that in FIG. 3, the mesh panel 1 is connected to the border through a flat braided rope 20 which is sewn to the mesh thereby allowing the webbing to slide within the flat braid rope, while in FIG. 4, the webbing is connected directly to the mesh.

Figure 9:
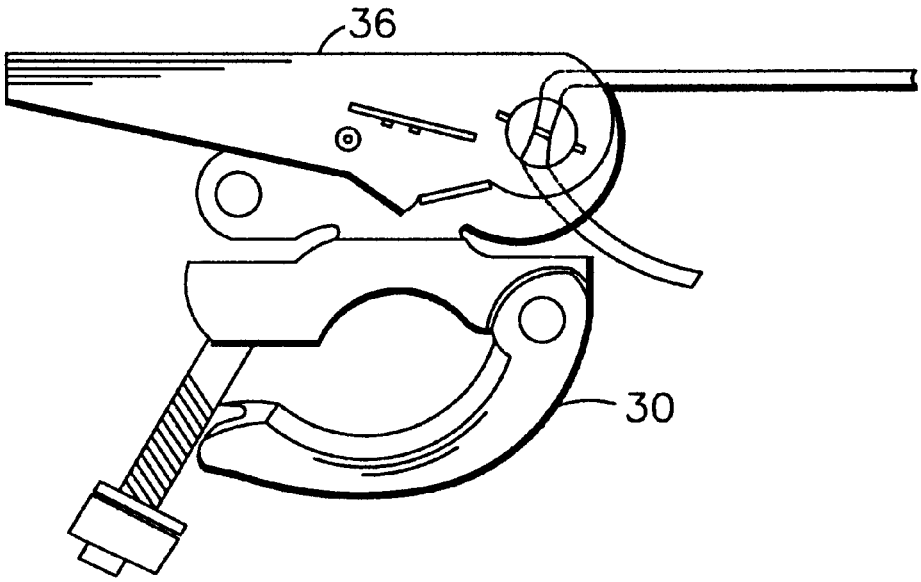
Figure 10:
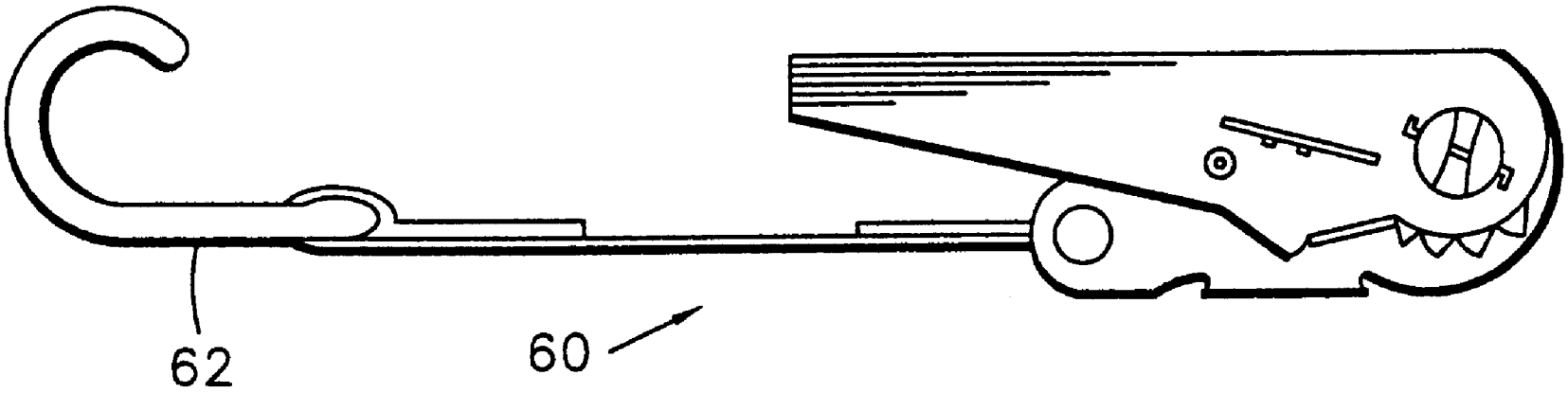
FIG. 10 illustrates a side elevation view of a ratchet device adapted for use with the panel illustrated in FIG. 5.
Figure 11B:
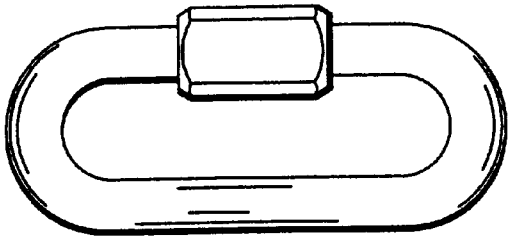
FIGS. 11*a*, 11*b* 11*c* and 11*d* illustrate hooks which connects the panel illustrated in FIG. 5 with the ratchet illustrated in FIG. 10.
Figure 11D:
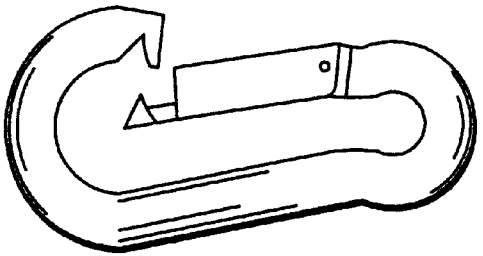
Figure 11A:
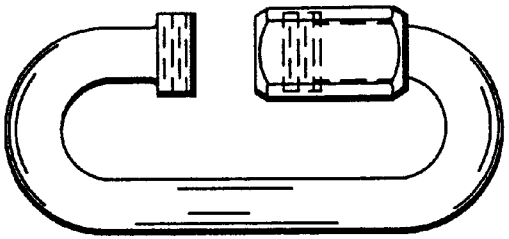
Figure 11C:
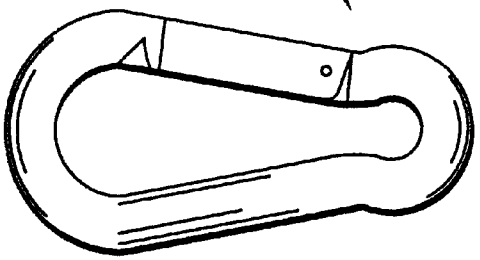

At the support members 5,5 are mounting connections 4,4 which connect the mesh to the structural members. The mounting connections 4,4 as illustrated in FIGS. 9, 10 and 11 can be integrally formed with a ratchet device, or alternatively can be separate members which connect the mesh with the scaffold as a separate element, such as by using a threaded member which pierces the mesh panel and thereafter threads into the transverse side of the scaffolding member. Alternatively, such separate connecting member may take the form of a tie wrap. The number of such mounting connections 4,4 are numerous along the length of each support member, and therefore as between successive such mounting connections, the mesh panels 1,1 are attached in regular or irregular patterns, depending on the desired effect.

As seen in FIG. 1, the mesh is a panel of fine-mesh fabric which takes on an opaque appearance when viewed from a distance to give a desired flat panel solid form when viewed from the outside and from afar. The mesh 1 is made from a color-fast material giving it color capability which can be coordinated with the environment it is being used in. Also, as seen in FIG. 1, each panel may be connected at spaced intervals to the scaffolding 7 to create a desired geometric pattern which goes with the architectural design of the structure. It should be noted here that the more open the mesh is, such as found with the debris mesh 1 in FIG. 1, the less visible the mesh is, but does reduce wind loads.

In the preferred embodiment, the mesh material 1 is desirably manufactured from 9×8, #18K flexible foamed PVC 1000 denier polyester, with minimum fabric weight of 9–10 oz. Per square yard, meet a minimum tensile strength, warp: 170 lbs/inch, fill: 155 lbs/inch minimum. Minimum tear strength, warp: 58 lbs., Fill: 55 lbs. (ASTM D2261-96). Fabric stretch, 27 lbs/inch; warp, 4 percent maximum; fill, 4 percent maximum; caliper, 45–50 mils. UV resistance, 1000 hours QUV exposure (ASTM G53096). Minimum fire retardancy: Federal Standards 191, method 5903.2 vertical 55 lbs/inch minimum. Color: Grayblue 18MW.

The 9×8 mesh 1 is a commercially available product which is sold by BO-Tex Sales Corporation, 175 Industrial Road, Hogansville, Ga. 30250. The mesh fabric is comprised of 22% high tenacity polyester yarn and 78% flexible foamed PVC. The yarns are intimately bonded at the cross-over points and the degree of openness is dependent on the fabric construction. Known mesh applications are for windscreens, horticultural shading in greenhouses and outside areas, personal sunscreen, and in the fabrication of outdoor stage sets. The following are more specific characteristics of the mesh which is used in the preferred embodiment.

| | |
|---|---|
| Construction: | 9 × 8 ends/inch |
| Coating: | Flexible Foamed PVC |
| Core Yarn: | 1000 denier Polyester |
| Fabric Weight: | 9–10 oz/sq. yd |
| Tensile Strength: | |
| (ASTM D-1682) | Warp: 170 lbs/inch minimum |
| Grab | Fill: 155 lbs/inch minimum |
| Tear Strength: | |
| (ASTM D-3786) | 58 lbs minimum warp |
| Tongue-single rip | 55 lbs minimum fill |
| Mullen Burst Strength: | |
| (ASTM D-3786) | 265 lbs/sq. in minimum |
| Caliper: | |
| (Fabric thickness) | 45–50 mils |
| Fire Retardancy: | As required. Mill run fabric is self extinguished in horizontal burning mode. Increased fire retardancy can be special order to meet specified tests. |
| Cold Crack: | No cracking after 24 hours @ 40° F., 2° mandrel |
| Fabric Stretch: | Warp 4% maximum |
| (ASRM D-1628, 27 lbs/inch) | Fill 4% maximum |
| UV Resistance: | |
| (ASTM G-53) | 1000 hours QUV exposure-slight color deterioration |
| Shade Factor: | 80% (78–82%) |

The mesh 1 in another embodiment can be comprised of yarn of 1,000 denier polyester running in a vertical direction as illustrated by elements and two 500 denier yarns running in a horizontal direction. The yarns are similarly coated by using a highly flexible foam PVC. It is the coating of the yarns which allows the material to be highly supple and flexible and soft to the touch. The below Table A illustrates the specific characteristics of the material. Also, the material is also sold by BO-Tex Sales Corporation, 175 Industrial Road, Hogansville, Ga. 80250 under part number BO-LOC7X5.

TABLE A

| | |
|---|---|
| Construction: | 7 × 5 ends/inch |
| Coating: | Flexible Foamed PVC |
| Core Yarn: | 100 denier Polyester |
| Fabric Weight: | 6.5–7.5 oz/sq. yd. |
| Tensile Strength: | |
| (ASTM D-2261) | 45 lbs. minimum warp |
| Tongue-single rip | 35 lbs. minimum fill |
| Mullen Burst Strength: (ASTM D-3786) | 257 lbs/sq in minimum |
| Fire Retardancy: | Afterflame: Less than 3 seconds (typical) |
| (Fed. Std. 191, Method 5903.2, Vertical) | Char Length: Less than 4 inches (typical) |
| Cold Crack: | No cracking after 24 hours @ −40° F., 2" mandrel |
| UV Resistance: | |
| (ASTM G53) | 1000 hours QUV exposure - slight color deterioration (Not applicable for fluorescent colors) |
| Specific Gravity: | 0.60 |

Colors Available Upon Request

Referring now to FIGS. 2–4, 8 and 9, it should be seen that the mesh panel shown in this embodiment includes a border member 20 which in the case of the embodiment shown in FIG. 3 includes an upper and a lower pocket member 22 which are attached to the upper and lower edges of the mesh 1 by folding over a length of the mesh on itself and stitching it along line 21. The pocket member 22 is a tubular member having an internal chamber 32 into which is received a web 30 which is somewhat free to slide therein, but is dimensioned so that it is tightly fitted within the internal chamber 32. The pocket member 22 takes the form of a hollow flat braid rope, such as disclosed in copending U.S. patent application Ser. No. 08/789,416 filed Jan. 29, 1997 and Entitled Flat Braid With Web Core, which is hereby incorporated by reference and the webbing 30 is of the type disclosed in same application as well. Thus, the mesh can be pulled tautly horizontally in the direction of the free ends of the web 30, when the web is pulled tautly itself.

It should be understood that the above types of materials are those which are disclosed by way of the preferred embodiment, but numerous substitutions may be had; such substitutions for the mesh material 1 may further be found with reference to the fine mesh material disclosed in the aforementioned copending U.S. application Ser. No. 09/012,472, entitled, Method of Using Barrier Material and System, filed Jan. 22, 1998 under EXPRESS MAIL No. EM174706093US.

Figure 8:
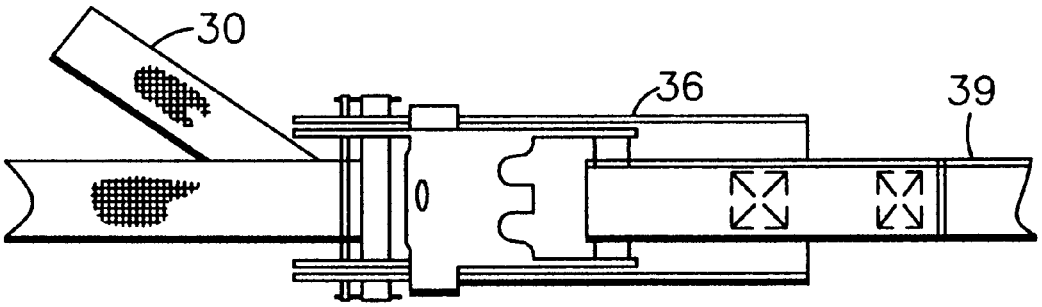
FIG. 8 is a partially fragmentary view illustrating a ratchet device with a panel web received therein.

Referring now to FIG. 4, it should be seen that the mesh panel shown in this embodiment is essential the same as that disclosed in FIG. 3 above, except that the border member 20 is comprised solely of a web length 30 which is serge stitched at 35 substantially along its length. It should be appreciated from the illustrations in FIGS. 3 and 4 that the rightmost edge 33 of the mesh panel 1 extending inwardly therefrom a distance of about the length L is left unattached to the web 30. While in the embodiment of FIG. 4, the mesh stitching 35 is simply stopped along length L, it should be understood that in the case of the embodiment shown in FIG. 3, the web 30 at point 33 is caused to pierce through the pocket member 22 and through the folded over sheet of mesh 1 in order to orient the web outside the panel in a side-by-side orientation with it. In this way, the distal ends of the web are allowed to be fed directly into a ratchet 36 in the manner illustrated in FIGS. 8 and 9 without interference from the corresponding length of mesh material. As illustrated in FIG. 9, each ratchet may have an integrally formed clamp 39 allowing it to be connected in a perpendicular relationship with the elongate extent of the scaffolding columns 5,5 to thereby receive the horizontally extending web 30 therein. Alternatively, as seen in FIG. 8 a strap 39 may be used to secured the ratchet to the support 5.

The length L of mesh material which is left unattached to the terminal ends of the web 30 may therefore be wrapped around the scaffolding columns to render a desired on the scaffolding, and thereby maintaining a flat form of the mesh across two scaffolding members 5,5.

Figure 7:
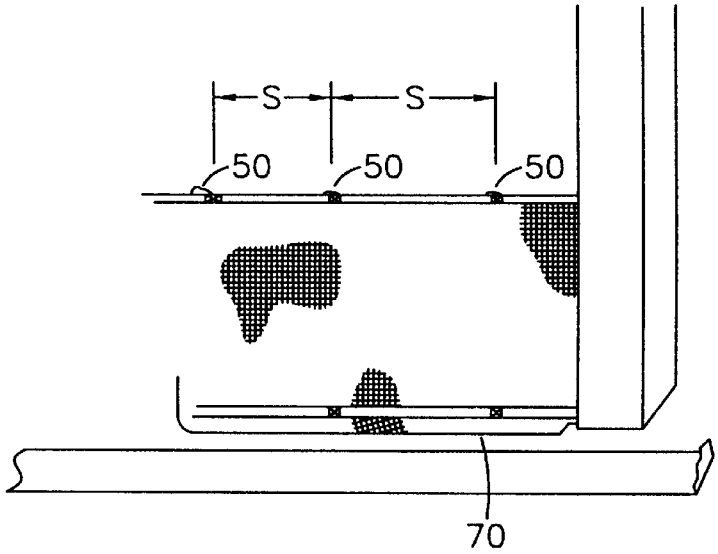
FIG. 7 is a partially fragmentary view of the panel illustrated in FIG. 5 in an assembled condition, and attached to a structural member, such as a column.
Figure 5:
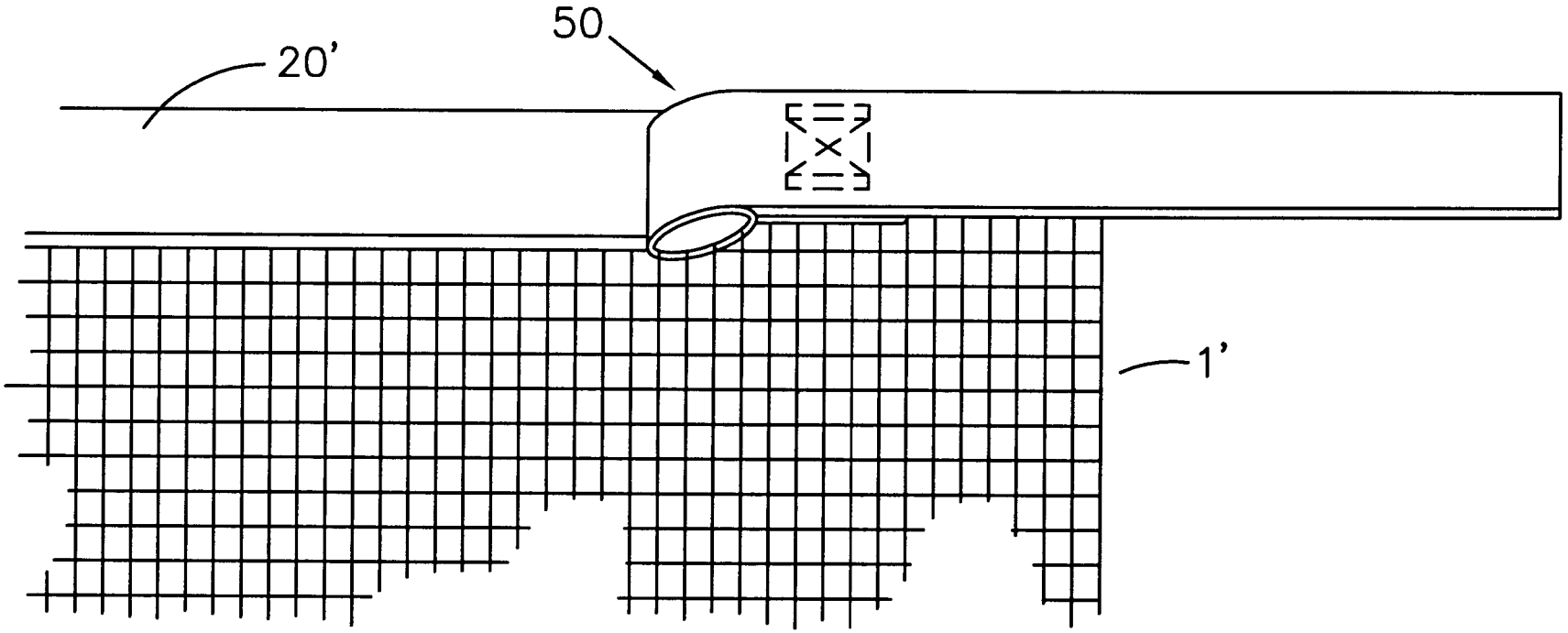
FIG. 5 illustrates a partially fragmentary elevational view of a third embodiment of a panel of the present invention showing the free end corner which is adapted to be received by a ratchet device.
Figure 6:
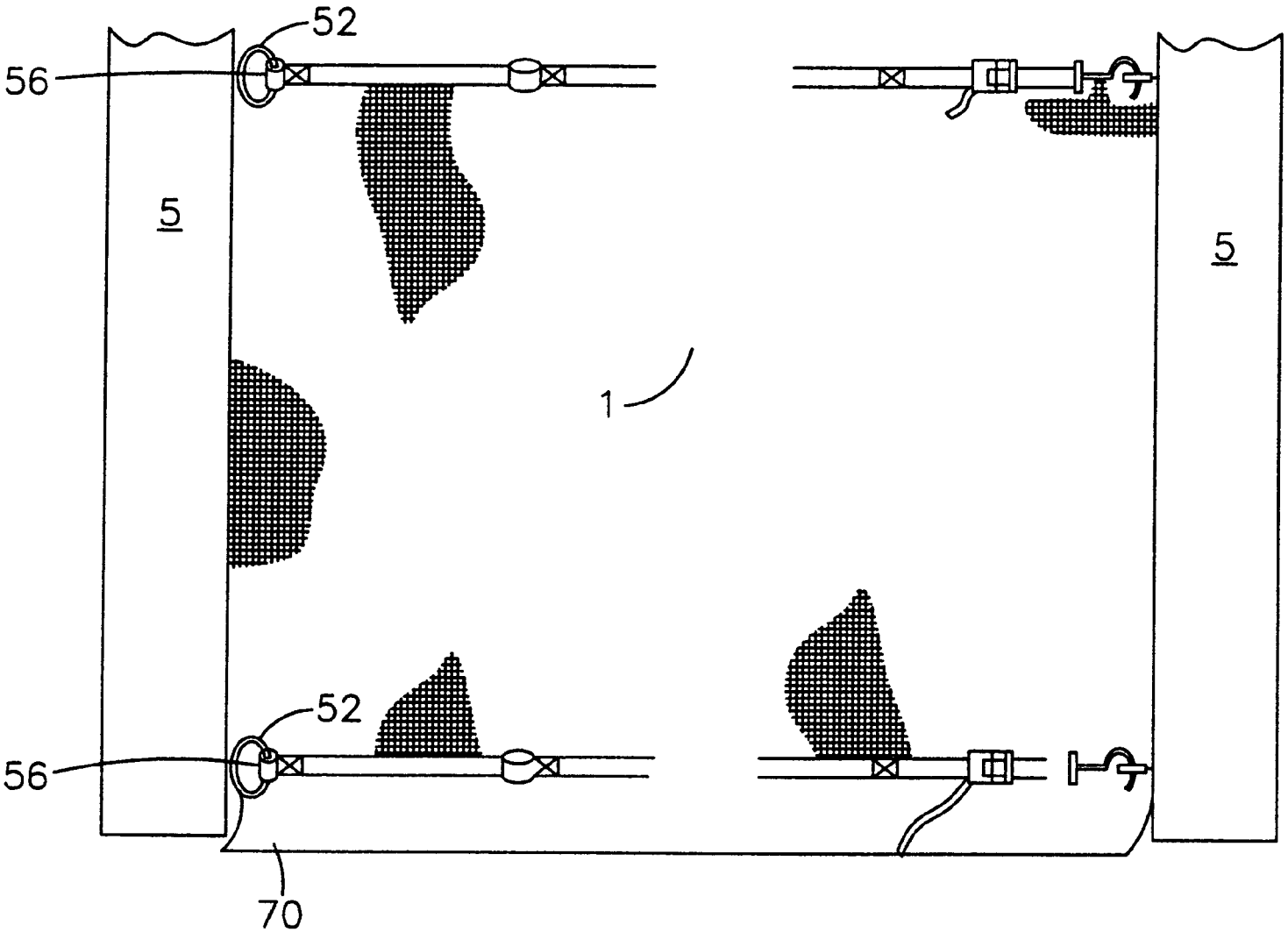
FIG. 6 illustrates the reverse side of the panel shown in FIG. 7 using a panel of the type illustrated in FIG. 5 as connected to a scaffolding system.

Referring now to FIGS. 5, 6 7, 10 and 11*a*–11*d*, it should be seen that as an alterative to using a border member which is sewn substantially along the entire length of the mesh as depicted by element 20 in FIGS. 3 and 4, the mesh panel 1' in FIGS. 5–7 employs a border 20' which is formed from a strip of webbing which is doubled back on itself at intervals, S,S to create a series of loops 50,50. The loops 50,50 are box stitched to the mesh panel material 1' at the intervals S,S such that the web material 20' which extends therebetween, e.g. along interval S,S, remains unattached to the mesh panel. In this way mesh material which is cut from a roll of stock material transversely of its length, i.e. of the borders 20', between the loops 50,50, will automatically be provided with a means for connecting the panel to a ratchet at one end and at the other end thereof to the scaffolding or concrete column, as illustrated in FIG. 6 or 7.

As illustrated in FIGS. 6, 10, and 11, to each of the scaffolding columns 5,5 is attached a hook 52 such as shown in FIGS. 11*a*–11*d*. These hooks may connect to a threaded eye bolt 56 which threads into the transverse side of the columns 5,5. when the stock mesh material is cut adjacent to a loop 50 it allows one end of the panel to be fit closely adjacent the leftmost column 5. However a certain amount of excess can be allowed to extended beyond the loop 50 end in order to wrap around the column if desired. Thus using a hook 52, the loops 50 connect the panel to the support 5 at one side, which in the illustrated example is the left side.

On the opposite side of the panel it is desirable to cut the panel such that a length of the border 20' is left so that it may be fed through a ratchet such as shown in FIGS. 8 and 9. However, it is also possible to use the loop 50 which is immediately adjacent the rightmost column as a fastening point for connecting directly to a ratchet such as shown in FIG. 10 at 60. The ratchet 60 has a curved arm 62 which is displaced by the ratchet mechanism to take in the border 20' when it is actuated. Thus, the curved arm 62 may be inserted into the loop 50 to make the connection between the support 5 and the mesh, or a hook 52 can make a splice connection between loops 52,52 in order to overlap the mesh of two panels and eliminate an opening therebetween.

Accordingly, the invention has been described by way of illustration rather than limitation. For example the reference to right left orientations has only been made for purposes of discussion and not limitation. Also, as seen in FIGS. 3 and 4, the border member and the mesh 1 cease to be connected along a length, L, associated with the free end portions of the panel. These free end portions of the panel act as a flap which may be independently secured to the column by wrapping around the column and connecting to itself. However, structurally, the panel connects to the columns via the border members which are sewn in place to the majority of the length of the panel. Additionally, as seen in FIGS. 6 and 7, the mesh panels 1, 1' may be oversized in length to allow for a horizontally disposed flap 70 to exist where needed, such as at the juncture of a deck.

Thus, the invention has been described by way of the preferred illustration rather than limitation.

I claim:

1. A system for connecting a panel to a support comprising:

a mesh panel defined by at least one length portion;

a tape-like web secured against movement along part of a length thereof to said at least one length portion of said mesh panel;

said web having a first end connectable to a support and a second end adjustable connectable to an opposite support;

a tensioning means associated with at least said web second end for pulling said panel in tension between said supports and for gripping and holding said web along any point along a length of said web between said web second end and where it is secured to said mesh panel; and wherein said length of said web associated with said second end being connectable to the tensioning means for pulling same and causing tension in the mesh panel.

2. A system as defined in claim 1 further characterized by said mesh panel having a grid size which renders an opaque appearance when viewed from a distance and prevents debris fallout.

3. A system as defined in claim 2 further characterized by said web having distal ends and said mesh panel having a length defined by opposite terminal ends and wherein said web is connected to said mesh panel between said distal ends thereof and wherein the distal ends of said web are not connected with the terminal ends of said mesh panel in order to create a flap portion for wrapping around one of said supports independently of the web.

4. A system as defined in claim 3 further characterized by said tensioning means including a ratchet device associated with the second end of said web; said ratcheting device including a means for connection to a support.

5. A system as defined in claim 4 further characterized by said web including a series of loops spaced apart from each other at intervals along said web, said web being connected to said mesh panel only at points corresponding to the placement of one of said loops.

6. A system as defined in claim 5 further characterized by said ratchet including a curved arm portion which is received within one of said loops to connect the web to a connecting support.

7. A system as defined in claim 6 further characterized by said mesh panel first end being connected to one of said support through a loop which is disposed immediately adjacent the support associated with said first end.

8. A system as defined in claim 7 further characterized by two mesh panels being connected to one another by overlapping a portion of a length thereof and connecting overlapped portions using aligned loops.

9. A system as defined in claim 4 further characterized by an elongated pocket member secured to the mesh panel having said flat tape-like web received therein; the pocket member having distal ends.

10. A system as defined in claim 9 further characterized by said web piercing said pocket member and extending outwardly thereof at a given distance from the distal ends of the pocket member.

11. A system as defined in claim 10 further characterized by the pocket member being a hollow flat braid rope and wherein said mesh panel connects to said rope by a folded over portion of said mesh panel and a connecting stitch.

12. A system as defined in claim 11 further characterized by said web being fed directly into said ratchet member.

13. A system as defined in claim 4 further characterized by said flat tape-like web member sewn substantially along the length of said mesh panel.

14. A system as defined in claim 2 further characterized by said web being fed directly into said ratchet member.

15. A system as defined in claim 1 further characterized by said mesh panel having two webs disposed in parallel relationship with one another along top and bottom lengths thereof.

* * * * *